US006143970A

United States Patent [19]

Kowzan

[11] Patent Number: 6,143,970

[45] Date of Patent: Nov. 7, 2000

[54] MUTE HOLDER FOR ATTACHMENT TO A MUSIC STAND

[76] Inventor: John P. Kowzan, 10808 N. College Pl. Dr., Spokane, Wash. 99218

[21] Appl. No.: 09/347,541

[22] Filed: Jul. 6, 1999

[51] Int. Cl.[7] ..... G10G 7/00

[52] U.S. Cl. ..... 84/453; 84/327; 84/329; 84/280; 211/70.1; 248/450

[58] Field of Search ..... 84/453, 327, 280, 84/329; 211/70.1, 70.6, 85.6; 248/450, 447.1, 111, 110

[56] References Cited

U.S. PATENT DOCUMENTS

| | | | |
|---|---|---|---|
| 4,300,743 | 11/1981 | Morris | 248/441 R |
| 4,488,469 | 12/1984 | Demello et al. | 84/385 A |
| 4,611,722 | 9/1986 | Teig | 211/107 |
| 4,759,252 | 7/1988 | Occhipinti | 84/387 |
| 5,488,890 | 2/1996 | Biasini | 84/280 |
| 5,890,605 | 4/1999 | Percudani | 211/87.01 |

*Primary Examiner*—David Martin
*Assistant Examiner*—Shih-yung Hsieh
*Attorney, Agent, or Firm*—David S. Thompson

[57] ABSTRACT

A mute holder for attachment to a music stand supports several mutes in a convenient manner. A mute is a device placed in the end of a trumpet or similar musical instrument to alter the sound. A number of mutes may be needed in the course of play. The mute holder provides an attachment bracket sized to attach to the support shelf on the music book support portion of a music stand. A preferred attachment bracket includes a retaining strip which is carried adjacent to a top portion of the mute holder. A resilient first bend between the top and retaining strip biases the strip against the top, allowing the bracket to clamp against the support shelf of the music book support. A back wall is attached to a rear edge of the top portion at an angle of approximately 90 degrees. A support plate is attached to the lower edge of the back wall, and is generally parallel to the top portion. The support plate defines one or more holes or openings, each such opening sized to support a similarly sized mute.

1 Claim, 3 Drawing Sheets

MUTE HOLDER FOR ATTACHMENT TO A MUSIC STAND

BACKGROUND

The tone of certain musical instruments, such as the trumpet, trombone and other wind instruments can be modified by the use of a number of different mutes. The use of several mutes during the course of a single session of play, or even a single musical piece is common.

It is frequently the case that a first mute, currently being used, must be rapidly swapped during the course of play for a second mute, which is needed to continue play. In many cases, this swap results in some rapid fumbling around as the player attempts to remove the first mute and replace the second mute. Where the player is overly hurried, the first mute may not be put into a location where it may be easily reached later.

As a result, what is needed is a mute holder which attaches to any music stand in a manner that is balanced and stable, and which allows organized support in an easily accessible manner of a number of different mutes.

SUMMARY

The present invention is directed to an apparatus that satisfies the above needs. A novel mute holder for attachment to a music stand is disclosed that attaches to any music stand in a manner that is balanced and stable, and which allows organized support in an easily accessible manner of a number of different mutes.

The mute holder for attachment to a music stand of the present invention provides some or all of the following structures.

(A) An attachment bracket is adapted for attachment to the shelf extending from the music book support portion of a typical music stand. A narrow slot running the length of the mute holder is defined between a top portion of the mute holder and a retaining strip carried immediately above the top portion. The slot is sized to frictionally hold the support shelf extending from the lower edge of the music book support of the music stand. A resilient first corner made of flexible material biases the retaining strip toward the upper surface of the top portion, thereby holding the shelf of the music stand within the attachment bracket.

(B) A back wall is oriented generally at right angles to the top portion, and extends downwardly from the top portion, typically by approximately 4 inches. The height of the back wall should be sufficient to accommodate the mutes carried between the top portion and the support plate.

(C) A support plate is carried by the lower edge of the back wall. The support plate defines one or more mute support holes and one or more mute support sites. The mute support sites and support holes are somewhat variable in size, but should be configured to support the mutes that are typically used by different horn players. As a result of the differences in horns, mutes and musical needs, the exact configuration of support holes or support sites may vary somewhat.

It is therefore a primary advantage of the present invention to provide a novel mute holder for attachment to a music stand that is sized to attach to any music stand without resulting in any reduction in performance, loss of balance or interference with the music book or sheet music supported by the music stand.

Another advantage of the present invention is to provide a novel mute holder for attachment to a music stand that supports a number mutes in an organized and easily accessible manner which allows a first mute to be put into a support site and a second mute to be removed from a support site for use in a rapid one-handed operation.

Another advantage of the present invention is to provide a novel mute holder for attachment to a music stand having one or more versions adapted to support the mutes used for a variety of musical wind instruments.

A still further advantage of the present invention is to provide a novel mute holder for attachment to a music stand that is easily manufactured by injection molding, extrusion methods, bending sheet plastic or by manufacture using other materials in a manner that allows of high quality and low cost.

DRAWINGS

These and other features, aspects, and advantages of the present invention will become better understood with regard to the following description, appended claims, and accompanying drawings where:

DESCRIPTION

Figures 1, 2:
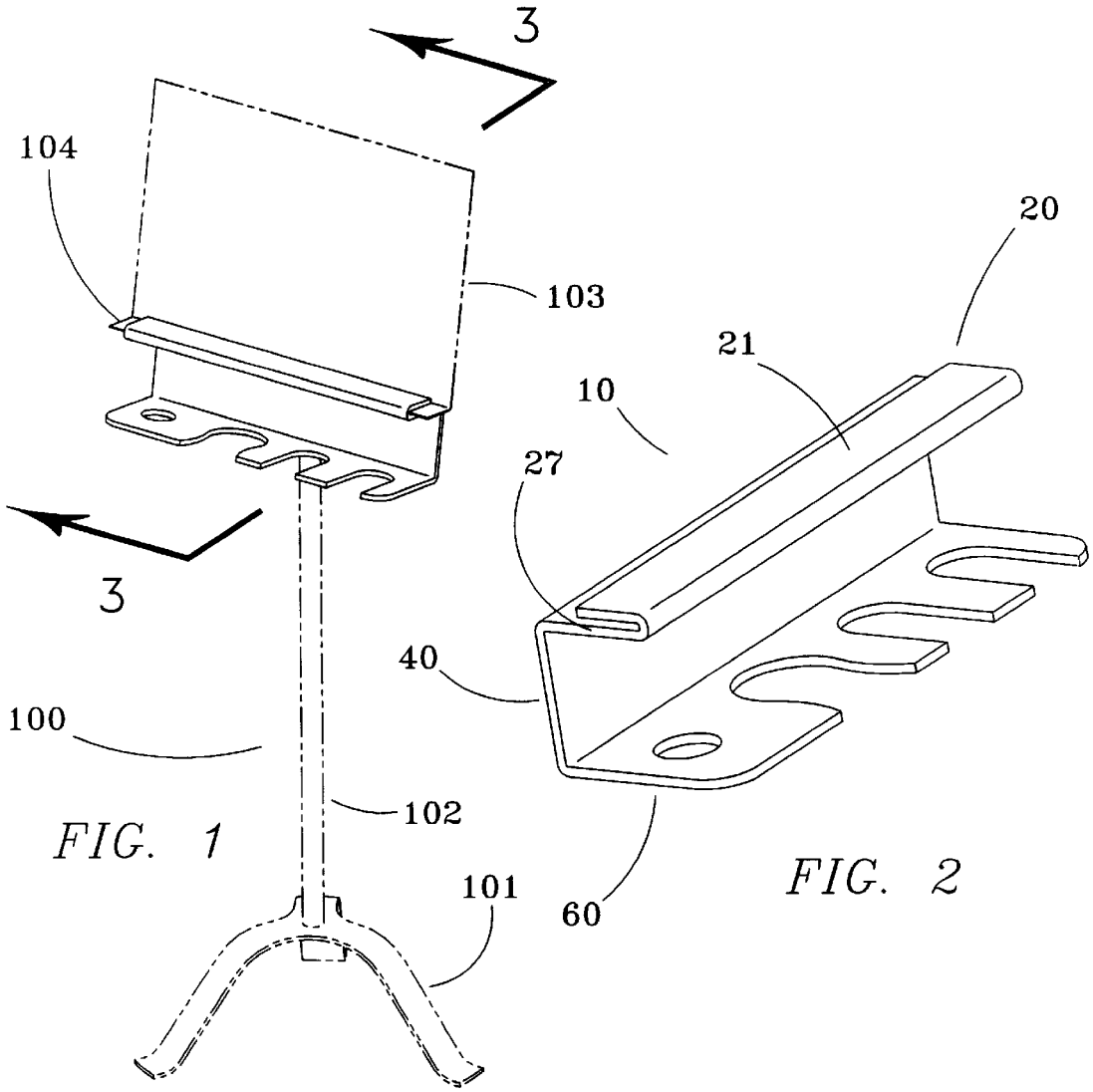
FIG. 1 is a perspective view of a version of the mute holder of the invention attached to a music stand.
FIG. 2 is a perspective view of the mute holder seen in FIG. 1, having the music stand removed for clarity.
Figure 3:
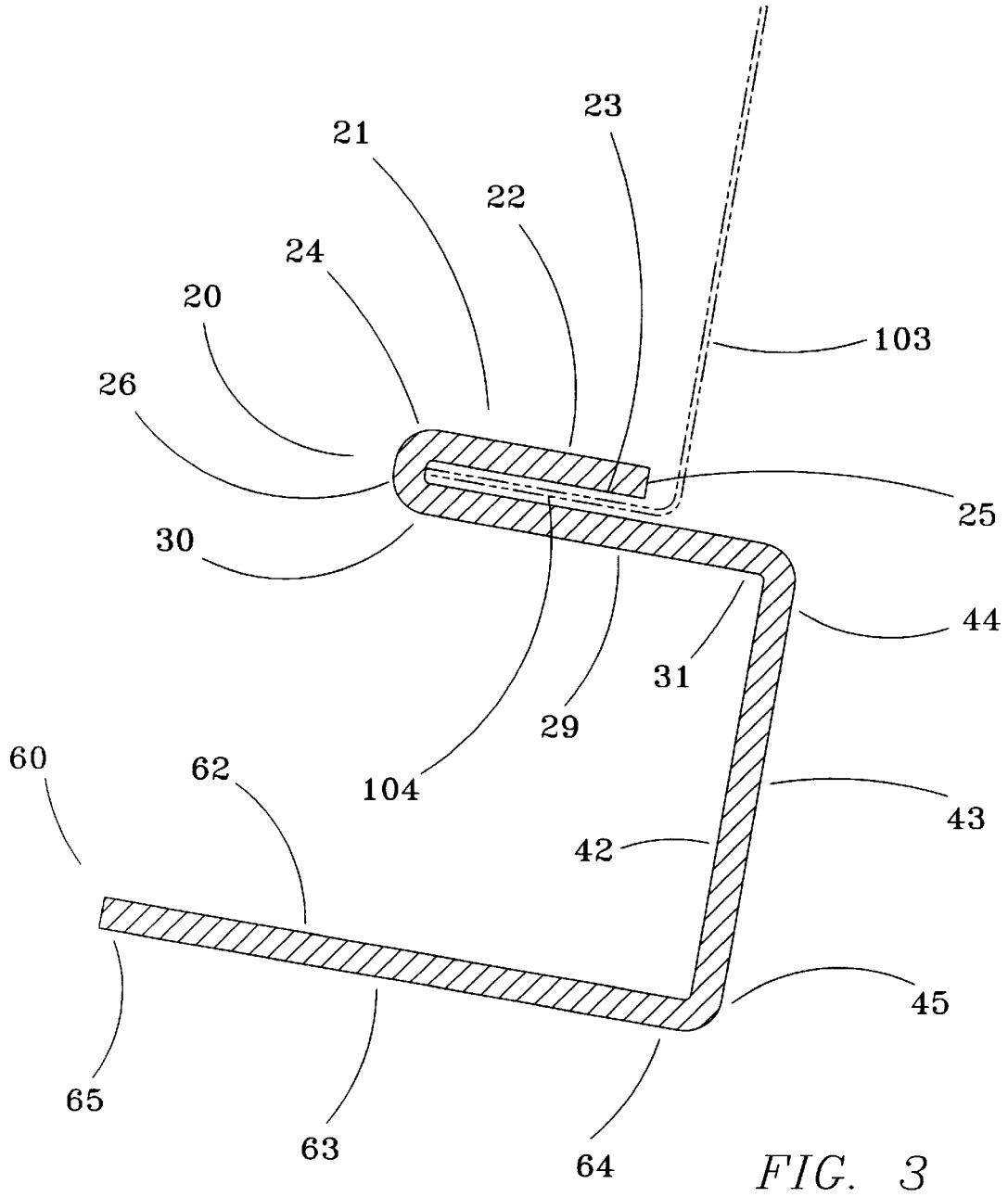
FIG. 3 is a cross-section taken along the 3—3 lines of FIG. 1.

Referring in generally to FIGS. 1 through 3, a mute holder 10 for attachment to a music stand constructed in accordance with the principles of the invention is seen. A preferred version of the mute holder provides an attachment bracket 20 which is sized to attach to the support shelf on the music book support portion of a music stand 100. A preferred attachment bracket includes a retaining strip 21 which is carried adjacent to a top portion 27 of the mute holder. A resilient first corner 24 between the top portion and retaining strip biases the strip toward the top, allowing the bracket 20 to clamp against the support shelf of the music book support. A back wall 40 is attached to a rear edge of the top portion at an angle of approximately 90 degrees. A support plate 60 is attached to the lower edge of the back wall, and is generally parallel to the top portion. The support plate defines one or more holes or openings forming mute support sites, each such opening sized to support a similarly sized mute.

Figure 4:
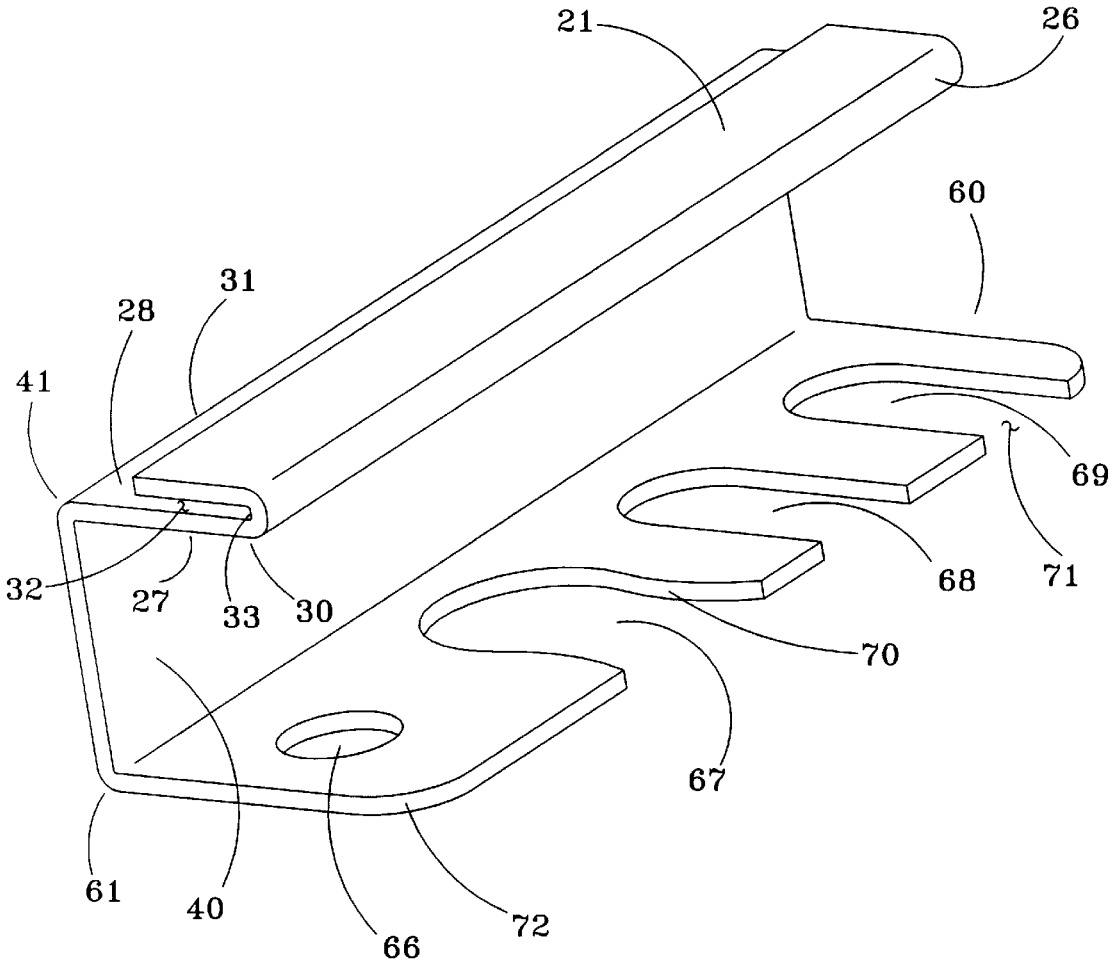
FIG. 4 is an enlarged view of the mute holder of FIG. 2.

As seen in FIG. 1, a typical music stand 100 is compatible for use with the mute holder of the invention. The stand, having a base 101 and support staff 102, is of a well-known variety. The music book support 103 provides a support shelf 104 which supports a music book or sheet music As seen in FIGS. 2 and 4, an attachment bracket 20 allows the mute holder to be firmly attached to the shelf 104 extending from the music book support 103 of a typical music stand. The preferred attachment bracket is formed from a top portion 27 and a retaining strip 21 joined by a first corner 26.

Referring particularly to the enlarged view of FIG. 4, it can be seen that while the exact dimensions are variable, the top portion is approximately 3" deep by 16" wide. A preferred top portion is made of plastic sheet or similar material.

Continuing to refer to the figures, a retaining strip 21 is carried approximately 3/16" from the upper surface 28 of the top portion 27. The preferred retaining strip is also made of plastic sheet material and is approximately 2" deep (from the first corner 26 to the rear edge 25) and 16" wide.

A resilient first corner 26 joins the forward edge 30 of the top portion and the forward edge 24 retaining strip 21. In a preferred version, the first corner is resiliently flexible, allowing the distance between the lower surface 23 of the retaining strip and the upper surface 28 of the top portion defining the slot 32 to be varied slightly. When the retaining strip is separated from the top portion by more that the relaxed spacing, the resilient first corner tends to bias the retaining strip toward the top portion, thereby narrowing the slot 32 in a manner which frictionally engages the shelf 104 of the music stand.

The slot 32 defined between the upper surface 28 of the top portion 27 and the lower surface 23 of the retaining strip should be sized to accept the shelf 104 of the music book support. The slot in a preferred version is 3/16" in height by 16" in width by 2" in depth, but can be made to fit any desired shelf 104. For example, where the support shelf 104 of the music stand is made of metal, and the forward edge is rolled to remove the possibility of a sharp edge and to present a quality look, the slot height may be increased slightly, to 0.25" or more.

An upper edge 44 of the back wall 40 is connected to the rear edge 31 of the top portion 27 by a second corner 41. In use, the back wall is oriented substantially vertically, with an inside surface 42 adjacent to the top portion and the support plate 60 and an outside surface 43 oriented to the music stand. While the dimensions of the back wall are somewhat variable, a preferred back wall is 16" wide by 4" tall. The width should be equal to the width of the top portion for strength and appearance. The height should be sufficient to provide adequate space between the top portion 27 and the support plate 60 to allow for storage of one or more mutes within the region generally bounded by the top portion, the back wall and the support plate. Where the vertical height of the back portion is insufficient, the mutes may be overly crowded or unable to fit between the top portion and the support plate.

A preferred version of the support plate 60 is carried by a lower edge 45 of the back wall and is shaped in a manner defining at least one mute support site, which enables support of at least one mute. Each of the mute support sites may be defined to support any desired mute; however, the preferred version of the mute holder 10 supports the mutes which are more popular and tend to be more commonly used.

A rear edge 64 of the support plate 60 is connected to the lower edge 45 of the back wall by a third corner 61. The third corner is approximately 90 degrees, and is generally rigid. The upper surface 62 of the support plate is generally parallel to the lower surface 29 of the top portion. In use, the lower surface 63 of the support plate is at a slight angle to the floor supporting the music stand.

As seen in FIG. 4, a preferred support plate defines a mute support hole 66, sized to support a "plunger," (type of mute) and first through third mute support sites 67, 68, 69 sized to support a Harmon mute, a cup mute and a straight mute, respectively. The forward edge 65 is broken by the curved edges 70 defining the mute support sites, and preferably has rounded corners 72. Each mute support site is defined by a curved edge 70 which is sized to accommodate the associated mute. A forward opening 71 allows the mute to easily be installed and removed from the mute support site.

The mute holder may be made of plastic, metal, wood or other material, although plastic is preferred. Polycarbonate plastic sheet having 0.080" thickness and 14" by 16" dimensions is preferred. The plastic sheet is first cut to result in the rounded corners 72. The curved edges 70 are cut to result in the mute support sites 67, 68, 69. The mute support hole 66 is also cut.

After cutting, the plastic is heated along a line 5 inches from the forward edge 65. When sufficiently hot, the plastic is bent at a 90 degree angle, as seen in FIG. 3, thereby forming the third corner 61.

After the third corner has cooled and strengthened, the plastic is heated along a line parallel to, and 4" from, the recently cooled bend. As before, when sufficiently hot, the plastic is bent at a 90 degree angle, as seen in FIG. 3, thereby forming the second corner 41.

After the second corner has cooled and strengthened, the plastic is again heated along a line parallel to, and 3" from, the recently cooled bend. Again, the plastic is bent, this time at an approximately 180 degree angle. This bend results in the slot 32 formed within a 3/16" gap which results between the upper surface of the top portion and the lower surface of the retaining strip.

Alternatively, the mute holder may be made using an injection molding process. Structurally, the resulting mute holder would be as described above, and would differ only in the manufacturing process.

As a still further alternative, the mute bolder may be made by an extrusion process using plastic or other materials. The extruded material is cut into segments of approximately 16" lengths, or as desired. The mute support hole 66 and mute support sites 67, 68, 69 would be most easily cut or routed from the lower surface 63 of the support plate.

To use the mute holder 10, the shelf 104 of the music stand is slid into place within the slot 32. The forward edge of the shelf typically contacts the inside corner 33 when the mute holder is fully installed. Sheet music or music books may be supported on the upper surface 22 of the retaining strip. The mutes needed by the musician are then placed in the mute support hole and the mute support sites. When needed, the mutes are readily available. During transport, the mutes may remain in position within the mute holder, if desired.

The previously described versions of the present invention have many advantages, including a primary advantage of providing a novel mute holder for attachment to a music stand that is sized to attach to any music stand without resulting in any reduction in performance, loss of balance or interference with the music book or sheet music supported by the music stand.

Another advantage of the present invention is to provide a novel mute holder for attachment to a music stand that supports a number mutes in an organized and easily accessible manner which allows a first mute to be put into a support site and a second mute to be removed from a support site for use in a rapid one-handed operation.

Another advantage of the present invention is to provide a novel mute holder for attachment to a music stand having one or more versions adapted to support the mutes used for a variety of musical wind instruments.

A still further advantage of the present invention is to provide a novel mute holder for attachment to a music stand that is easily manufactured by injection molding, extrusion methods, bending sheet plastic or by manufacture using other materials in a manner that allows of high quality and low cost.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while certain sizes and dimensions have been disclosed, other similar dimensions could easily result where the mute holder was to be used for an alternate horn type having slightly differently sized mutes. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A mute holder for attachment to a shelf extending from a music book support of a music stand, the mute holder comprising:

(A) attachment bracket means for attachment to the shelf extending from the music book support of the music stand, the attachment bracket means comprising:

(a) a top portion having a forward edge and a rear edge;

(b) a retaining strip having a forward edge carried immediately above the top portion, the top portion and the retaining strip defining a slot between them; and (c) resilient first corner means, joining the forward edge of the top portion and the forward edge of the retaining strip, for biasing the retaining strip toward the top portion;

(B) a back wall extending perpendicularly from the rear edge of the top portion; and (C) a support plate carried by a lower edge of the back wall, the support plate defining a mute support hole, the support plate also having a forward edge defining first, second and third mute support sites, each mute support site having a forward opening defined in the forward edge of the support plate.

* * * * *